US006190463B1

(12) United States Patent
Itami et al.

(10) Patent No.: US 6,190,463 B1
(45) Date of Patent: Feb. 20, 2001

(54) PROCESS FOR PRODUCING FE-CO BASED MAGNETIC ALLOY HAVING EXCELLENT MECHANICAL PROPERTIES

(75) Inventors: Hitoshi Itami; Nagatsugu Mukaibo, both of Wako; Tetsuya Kondo, Nagoya, all of (JP)

(73) Assignee: Honda Giken Kogyo Kabushiki kaisha, Tokyo (JP)

( * ) Notice: Under 35 U.S.C. 154(b), the term of this patent shall be extended for 0 days.

(21) Appl. No.: 09/203,496

(22) Filed: Dec. 1, 1998

(30) Foreign Application Priority Data

Dec. 2, 1997 (JP) ..... 9-331824

(51) Int. Cl.[7] ..... H01F 1/14
(52) U.S. Cl. ..... 148/121; 148/120; 148/101
(58) Field of Search ..... 148/101, 102, 148/120, 121

(56) References Cited

U.S. PATENT DOCUMENTS 3,891,475 * 6/1975 Tomita et al. ..... 148/121
4,008,105 * 2/1977 Yuda et al. ..... 148/101
4,075,437 * 2/1978 Chin et al. ..... 148/108
4,366,007 * 12/1982 Inoue ..... 148/102

* cited by examiner

*Primary Examiner*—John Sheehan
(74) *Attorney, Agent, or Firm*—Arent Fox Kintner Plotkin & Kahn PLLC

(57) ABSTRACT

A process for prooducing an Fe—Co based magnetic alloy having not only good magnetic properties but also excellent mechanical characteristics is provided which includes a first step of heating an Fe—Co based magnetic alloy material having a Co content which is in a range of 30% by weight≦Co≦65% by weight to convert the metallographic structure thereof into a γ single-phase structure, a second step of gradually cooling the material to an a single-phase range at a cooling rate $C_1$ set in a range of 20 K°/hr≦$C_1$≦0.5 K°/sec, and a third step of subjecting the material to a magnetic softening treatment.

10 Claims, 6 Drawing Sheets

PROCESS FOR PRODUCING FE-CO BASED MAGNETIC ALLOY HAVING EXCELLENT MECHANICAL PROPERTIES

BACKGROUND OF THE INVENTION

1. Field of the Invention

The present invention relates to a process for producing Fe—Co based magnetic alloys having excellent mechanical characteristics, and particularly, to a process for producing an Fe—Co based magnetic alloy having a Co content which is in a range of 30% by weight≦Co≦65% by weight.

2. Description of the Related Art

In the course of producing an Fe—Co based magnetic alloy having a composition as described above, it is conventional practice to subject the material to a magnetic softening treatment for the purpose of improving magnetic properties after processing of the alloy. In this magnetic softening treatment, the material is maintained, for example, at 1,123° K for 3 hours, whereby the metallographic structure is converted into a ferrite structure (which will be referred to as α structure hereinafter). Then, the resulting material is gradually cooled at a cooling rate of 100 to 200 K°/hr, and at such a cooling rate, an order-disorder transition is produced to provide an α structure of CuZn-type ($L2_0$ type) ordered lattice.

However, while the Fe—Co based magnetic alloy has good magnetic properties because it has the α' structure, it suffers from a problem that it has poor mechanical characteristics, particularly, a decreased toughness, resulting in a narrower available range.

SUMMARY OF THE INVENTION

Accordingly, it is an object of the present invention to provide a production process of the above-described type, which is capable of producing an Fe—Co based magnetic alloy having not only good magnetic properties but also excellent mechanical characteristics and particularly, an increased toughness.

To achieve the above object, according to the present invention, there is provided a process for producing an Fe—Co based magnetic alloy, comprising a first step of heating an Fe—Co based magnetic alloy material having a Co content which is in a range of 30% by weight≦Co≦65% by weight to convert the metallographic structure into a γ single-phase structure, a second step of gradually cooling the material to an a single-phase range at a cooling rate $C_1$ set in a range of 20 K°/hr <C, <0.5 K°/sec (i.e., 20 K°/hr $<C_1<$1,800 K°/hr), and a third step of subjecting the material to a magnetic softening treatment, wherein the first to third steps are carried out in the mentioned order.

In the above production process, if the homogeneous γ single-phase structure produced in the first step is gradually cooled to the a single-phase range at the cooling rate $C_1$ in the second step, a mixed structure comprising an a phase and an intermediate phase can be produced. An integrated heat energy in the magnetic softening treatment in the third step participates in the growing of grains. A portion of the integrated heat energy is consumed as the energy required for the subsequent order-disorder transition, whereby the a phase is converted into the α' phase. The intermediate phase cannot receive sufficient order-disorder transition, because the heat energy of the intermediate phase is consumed in the transformation to the a phase and growing of the grains in the magnetic softening treatment, and thus, a portion of the intermediate phase is left as the a phase. As a result, a mixed structure comprising the α phase and the α' phase is produced.

In this way, the Fe—Co based magnetic alloy has the α structure in addition to the α' phase required for enhancing magnetic properties. This α structure contributes to the enhancement in the mechanical properties and particularly, the toughness of the magnetic alloy. The mixed α–α' structure is a structure having a uniform grain size and is obtained by the transformation from the homogeneous γ phase and the growing of grains. This is also effective for enhancing the mechanical characteristics of the Fe—Co based magnetic alloy.

According to the present invention, it is possible to produce the Fe—Co based magnetic alloy having not only good magnetic properties but also excellent mechanical characteristics and hence, it is possible to provide an increase in performance of and a reduction in size of an actuator or the like. In addition, the production process can be continuously carried out from the first step to the third step, whereby the treatment time can be shortened. Further, at completion of the second step, the material has a high elongation and a high Charpy impact value and hence, at this stage, a process utilizing the high mechanical property can be carried out.

However, if the cooling rate $C_1$ in the second step is set in a range of $C_1$>0.5 K°/sec, a martensite transformation is produced and for this reason, the desired mixed α–α' structure cannot be obtained. On the other hand, if $C_1$<20 K°/hr, the a single-phase structure is provided before completion of the second step and for this reason, the desired mixed α–α' structure cannot be obtained even by the subsequent thermal treatment.

The above and other objects, features and advantages of the invention will become apparent from the following description of the preferred embodiment taken in conjunction with the accompanying drawings.

DETAILED DESCRIPTION OF THE PREFERRED EMBODIMENTS

Figure 1:
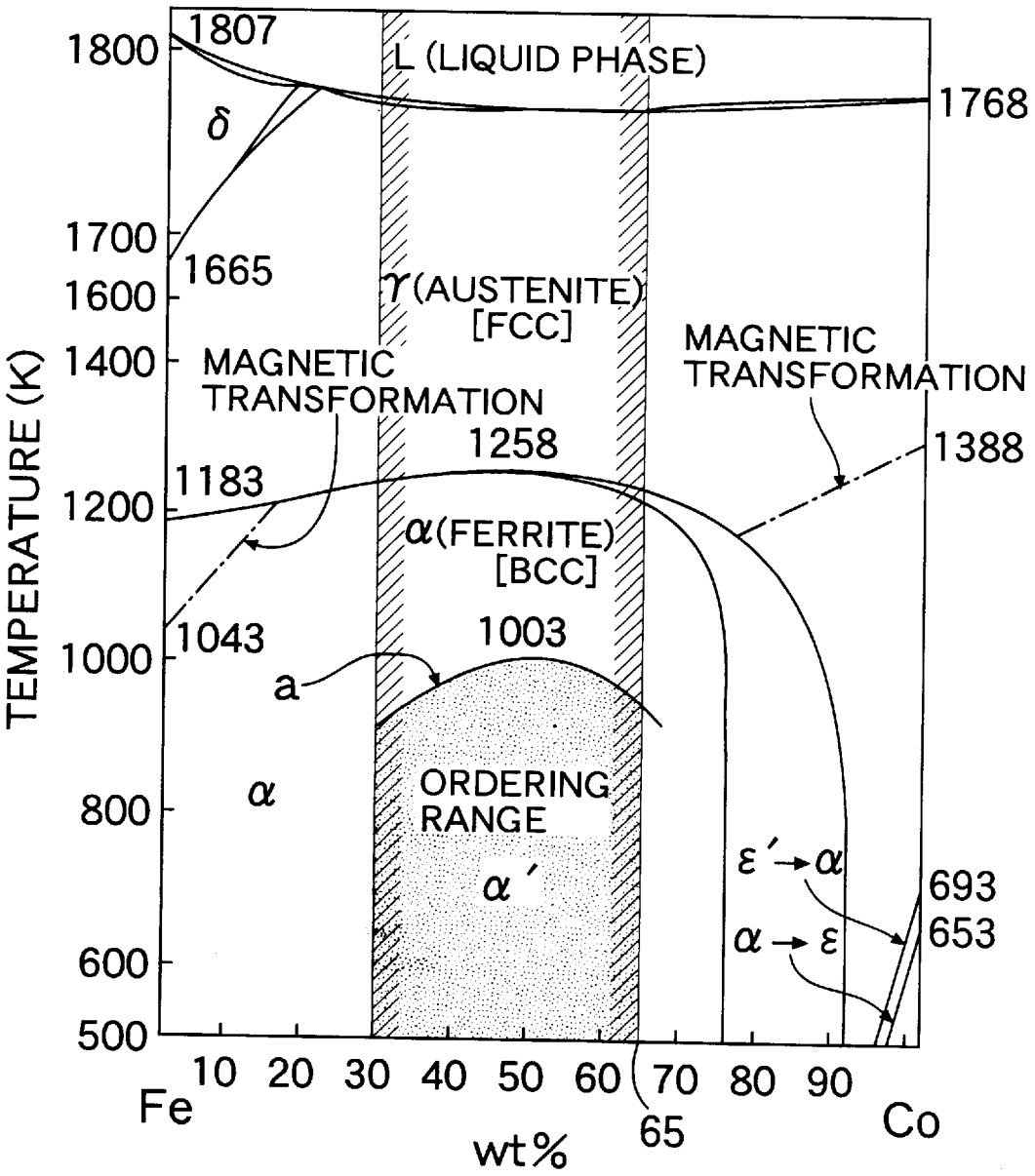
FIG. 1 is a diagram of an Fe—Co binary state.

FIG. 1 is a diagram of the Fe—Co binary state. The present invention is directed to an Fe—Co based magnetic alloy having a Co content which is in a range of 30% by weight≦Co≦65% by weight.

In producing such an Fe—Co based magnetic alloy, first, second and third steps, which will be described below, are carried out sequentially using an Fe—Co based magnetic alloy material having the above-described composition and according to one example of a heat cycle in FIG. 2.

First Step:

The material is heated, whereby the metallographic structure thereof is converted into a homogenous γ single-phase structure. In this case, the heating temperature $T_1$ is set in a range of 1,273° K≦$T_1$≦1, 623° K, and the retention time $t_1$ at such temperature is set in a range of 0.5 hr≦$t_1$≦10 hr. However, if the heating temperature $T_1$ is lower than 1,273° K, the entire material cannot be formed into the γ single-phase structure. This is an obstacle to the enhancement of the magnetic properties. This disadvantage also occurs when the retention time $t_1$ is shorter than 0.5 hr. On the other hand, if the heating temperature $T_1$ is higher than 1,623° K, the crystal grains are coalesced, resulting in degraded mechanical characteristics. The same occurs when the retention time $t_1$ is longer than 10 hr.

Second step:

The material is cooled gradually, for example, furnace-cooled to an a single-phase range at a cooling rate $C_1$ set in a range of 20 K°/hr≦$C_1$≦0.5 K°/sec. The cooling-end temperature included in the a single-phase range is set, for example, at a retention temperature in the magnetic softening treatment of the subsequent step. If the γ single-phase structure produced in the first step in the above-described manner is gradually cooled to the a single-phase range at the above-described cooling rate $C_1$ in the second step, a mixed structure comprising an a phase and an intermediate phase can be formed.

Third Step:

The material is subjected to the magnetic softening treatment. The retention temperature $T_2$ in this treatment is set in a range of 1,073° K≦$T_2$≦1,143° K, and the retention time $t_2$ at such temperature is set in a range of 0.5 hr≦$t_2$≦10 hr. The cooling course is further divided into a gradual stage and a quick cooling stage. The gradual cooling stage is carried out from the retention temperature $T_2$ to a quick-cooling starting temperature $T_3$ (=973° K), wherein furnace-cooling is applied. The cooling rate in this case is set in the range of $C_2$≦0.06 K°/sec. The quick cooling stage is carried out from the quick-cooling starting temperature $T_3$ to room temperature $T_4$, wherein gas-cooling is employed. It is preferable to use an inert gas such as $N_2$ or Ar gas or the like which does not oxidize the material.

In the third step, the material passes through an order-disorder transition temperature shown by a line a in FIG. 1 in the gradual cooling stage. During this time, the integrated heat energy participates in the growing of grains, but a portion of the integrated heat energy is consumed as the energy required for the subsequent order-disorder transition, whereby the α phase is converted into the α' phase. Sufficient order-disorder transition of the intermediate phase cannot occur in the third step, because the heat energy of the intermediate phase is consumed for the transformation to the a phase and the growing of grains in the magnetic softening process, and thus, a portion of the intermediate phase is left as the α phase. As a result, the mixed-phase structure comprising the a phase and the α' phase is produced.

In this way, the Fe—Co based magnetic alloy has the α structure in addition to the α' structure required for enhancing the magnetic property of the Fe—Co based magnetic alloy. This α structure contributes to the enhancement of the mechanical characteristics and particularly, the toughness of the magnetic alloy. The mixed α–α' structure is a structure having a uniform grain size and is produced by the transformation from the homogeneous γ phase and the growing of grains. This is also effective for enhancing the mechanical characteristics of the Fe—Co based magnetic alloy.

However, when the retention temperature $T_2$ is lower than 1, 073° K, the integrated heat energy is insufficient, and for this reason, the order-disorder transition does not sufficiently occur in the gradual cooling stage, whereby the magnetic properties cannot be improved. The same occurs when the retention time $t_2$ is shorter than 0.5 hr. If the cooling rate $C_2$ is higher than 0.06 K°/sec and if the quick-cooling starting temperature $T_3$ is higher than 973° K, the lattice is newly distorted in the cooling program, thereby bringing about a degradation of the magnetic properties. On the other hand, if the retention temperature $T_2$ is higher than 1,143° K, the magnetic properties in a lower magnetic field are degraded. The same occurs when the retention time $t_2$ is longer than 10 hr.

Figure 2:
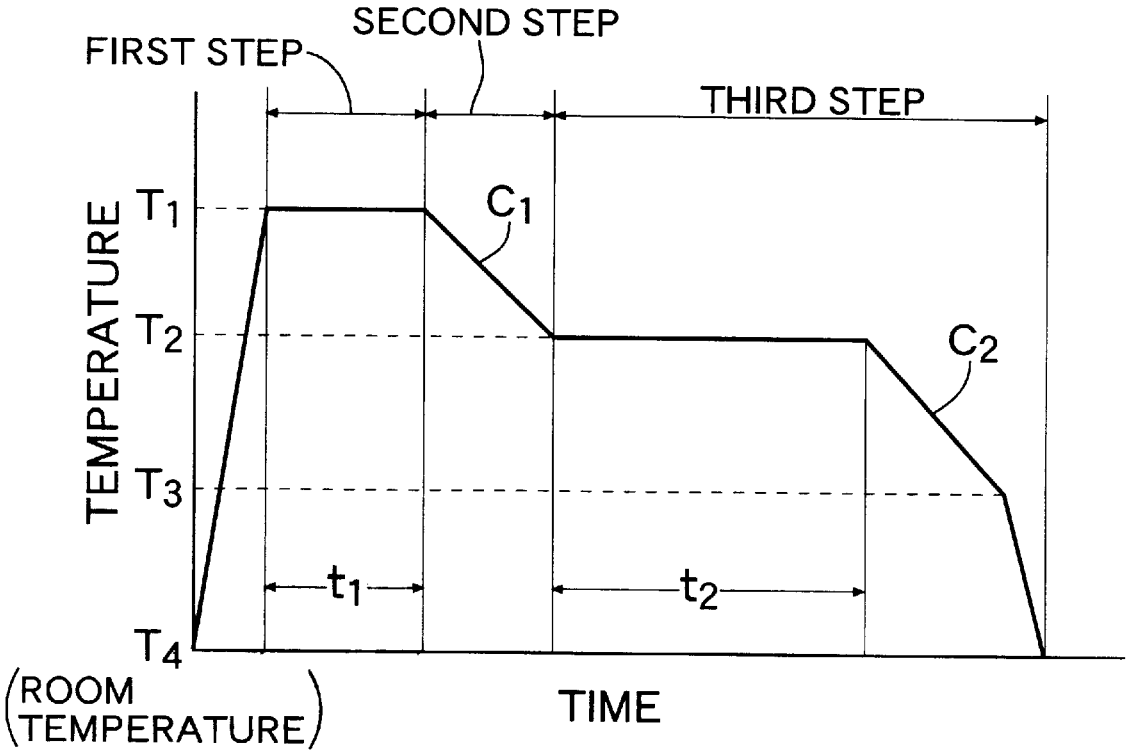
FIG. 2 shows one example of a heat cycle.

When the heat cycle shown in FIG. 2 is employed, the processing of the material e.g., cutting or machining of the material, is carried out before starting the first step, i.e., before raising the temperature. This is because if the Fe—Co based magnetic alloy produced after the third step is subjected to the cutting or the like, the magnetic properties of the alloy are degraded.

Figure 3:
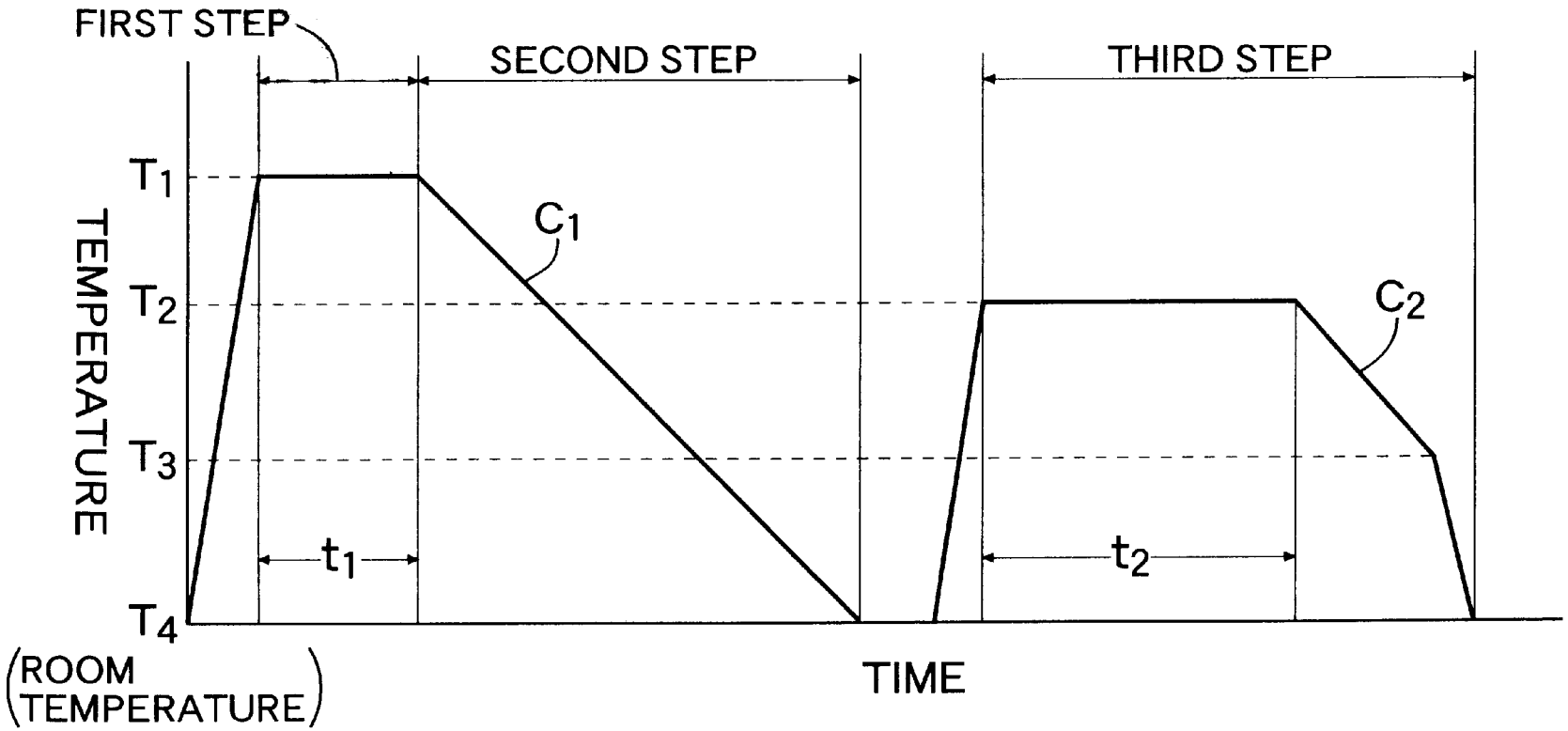
FIG. 3 shows another example of a heat cycle.

FIG. 3 shows another example of the heat cycle. In this example, the material is gradually cooled to room temperature $T_4$ at the cooling rate $C_1$ in the second step. This provides an enhancement in mechanical characteristics of the material. Therefore, utilizing this, the material is subjected to a mechanical processing, a plastic processing or the like and then, the third step is carried out.

Particular examples will be described below.

First, a large number of test pieces each comprising 49% by weight of Co, 2% by weight of V and the balance of Fe, including inevitable impurities, were prepared as Fe—Co based magnetic alloy materials.

Then, as examples of the present invention, each of the materials was subjected to the first, second and third steps under conditions given in Table 1, thereby producing Examples 1 to 13 of Fe—Co based magnetic alloys.

TABLE 1

| Example of Fe—Co based magnetic alloy | Examples of the Present Invention | | | | | | |
|---|---|---|---|---|---|---|---|
| | First Step | | Second Step | Third Step | | | |
| | $T_1$ (° K.) | $t_1$ (hr) | $C_1$ (° K./sec) | $T_2$ (° K) | $t_2$ (hr) | $C_2$ (° K./sec) | $T_3$ (° K.) |
| 1 | 1273 | 10 | | | | | |
| 2 | 1373 | 2 | 0.04 | 1103 | 3 | 0.04 | 773 |
| 3 | 1473 | | | | | | |
| 4 | | | | 1073 | | | |
| 5 | | | | 1143 | 0.5 | | |
| 6 | | | | 1123 | 2 | | 373 |
| 7 | | | | 1103 | 3 | 0.04 | 873 |
| 8 | | | | | | | 973 |
| 9 | | | 0.5 (cooled to $T_4$) | | | | 773 |
| 10 | 1573 | 1 | 0.04 | | | | |
| 11 | | 2 | 0.14 | | | | |
| 12 | 1623 | 0.5 | 0.04 | | | | |
| 13 | 1473 | 2 | 0.006 | | | | |

On the other hand, as comparative examples, each of the materials was subjected to the first, second and third steps under conditions given in Table 2, thereby producing Examples 14, 15, 17, 18 and 20 to 23 of Fe—Co based magnetic alloys. Each of Examples 16 and 19 of such an alloy was produced excluding the third step, and Example 24 of the alloy is produced excluding the first and second steps.

TABLE 2

| Example of Fe—Co based magnetic alloy | Examples of the Present Invention: First Step $T_1$ (° K.) | First Step $t_1$ (hr) | Second Step $C_1$ (° K./sec) | Third Step $T_2$ (° K) | Third Step $t_2$ (hr) | Third Step $C_2$ (° K./sec) | Third Step $T_3$ (° K.) |
|---|---|---|---|---|---|---|---|
| 14 | 1223 | 5 | 0.04 | 1103 | 3 | 0.04 | 773 |
| 15 | 1373 | 2 | 100 | | | | |
| 16 | | | 100 (cooled to $T_4$) | — | — | — | — |
| 17 | 1473 | | 0.04 | 1103 | 3 | gas-cooled from $T_2$ | |
| 18 | | | | 1173 | 0.5 | 0.04 | 773 |
| 19 | | | 0.5 (cooled to $T_4$) | — | — | — | — |
| 20 | 1573 | | 0.04 | 923 | 3 | 0.04 | 773 |
| 21 | | | | 1103 | 0.08 | | |
| 22 | 1673 | 0.5 | | | 3 | | |
| 23 | 1473 | 2 | 0.003 | | | | |
| 24 | — | — | — | | | | |

Examples 1 to 13 were examined for magnetic properties and mechanical characteristics to provide results given in Table 3. The magnetic properties were measured with respect to the magnetic flux densities $B_5$ and $B_{25}$.

TABLE 3

| Example of Fe—Co based magnetic alloy | Magnetic Properties Magnetic density flux (T) $B_5$ | $B_{25}$ | Mechanical Characteristics: Tensile strength (MPa) | Elongation (%) | Charpy impact value (J/cm$^2$) |
|---|---|---|---|---|---|
| 1 | 1.60 | 1.98 | 562.7 | 7.31 | 34.59 |
| 2 | 1.66 | 2.05 | 522.5 | 7.07 | 23.62 |
| 3 | 1.73 | 2.12 | 475.5 | 6.27 | 21.85 |
| 4 | 1.69 | 2.09 | 489.2 | 6.72 | 23.03 |
| 5 | 1.72 | 2.01 | 541.2 | 6.13 | 19.01 |
| 6 | 1.72 | 2.14 | 477.5 | 6.23 | 21.66 |
| 7 | 1.71 | 2.13 | 478.4 | 6.30 | 22.34 |
| 8 | 1.65 | 2.05 | 494.1 | 5.86 | 22.83 |
| 9 | 1.87 | 2.19 | 500.0 | 5.71 | 21.76 |
| 10 | 1.77 | 2.08 | 430.4 | 5.14 | 18.42 |
| 11 | 1.74 | 2.07 | 465.7 | 5.55 | 22.15 |
| 12 | 1.67 | 2.18 | 426.5 | 5.38 | 16.76 |
| 13 | 1.85 | 2.20 | 438.1 | 5.21 | 14.99 |

Examples 14 to 24 were likewise examined for magnetic properties and mechanical characteristics to provide results given in Table 4. The magnetic properties were likewise measured with respect to the magnetic flux densities $B_5$ and $B_{25}$.

TABLE 4

| Example of Fe—Co based magnetic alloy | Magnetic Properties Magnetic density flux (T) $B_5$ | $B_{25}$ | Mechanical Characteristics: Tensile strength (MPa) | Elongation (%) | Charpy impact value (J/cm$^2$) |
|---|---|---|---|---|---|
| 14 | 0.97 | 1.68 | 598.0 | 7.52 | 42.04 |
| 15 | 1.71 | 2.13 | 379.4 | 2.48 | 19.31 |
| 16 | 0.56 | 1.14 | 995.1 | 23.20 | 84.18 |
| 17 | 1.50 | 2.07 | 586.3 | 5.24 | 24.30 |

TABLE 4-continued

| Example of Fe—Co based magnetic alloy | Magnetic Properties Magnetic density flux (T) $B_5$ | $B_{25}$ | Mechanical Characteristics: Tensile strength (MPa) | Elongation (%) | Charpy impact value (J/cm$^2$) |
|---|---|---|---|---|---|
| 18 | 1.28 | 2.04 | 560.8 | 6.11 | 18.42 |
| 19 | 0.15 | 1.43 | 800.0 | 9.28 | 50.66 |
| 20 | 1.23 | 1.81 | 584.3 | 6.44 | 26.56 |
| 21 | 1.18 | 1.96 | 601.0 | 6.02 | 16.95 |
| 22 | 1.14 | 1.84 | 350.0 | 4.57 | 16.56 |
| 23 | 1.84 | 2.19 | 415.8 | 4.92 | 3.51 |
| 24 | 1.79 | 2.18 | 417.6 | 4.80 | 3.33 |

Example 24 given in Table 4 was produced by subjecting the material to only the third step, namely to only the magnetic softening treatment and hence, is the same as a product made by the prior art process. If Example 24 is compared with Examples 1 to 13, it is obvious that each of Examples 1 to 13 has good magnetic properties, substantially similar to that of Example 24, and also has good mechanical characteristics, remarkably better than that of Example 24. It is also obvious from Table 4 that the coexistence of the desirable magnetic properties and mechanical characteristics, as in Examples 1 to 13, does not exist in Examples 14 to 24. This is due to the difference between the production conditions.

Figure 4:
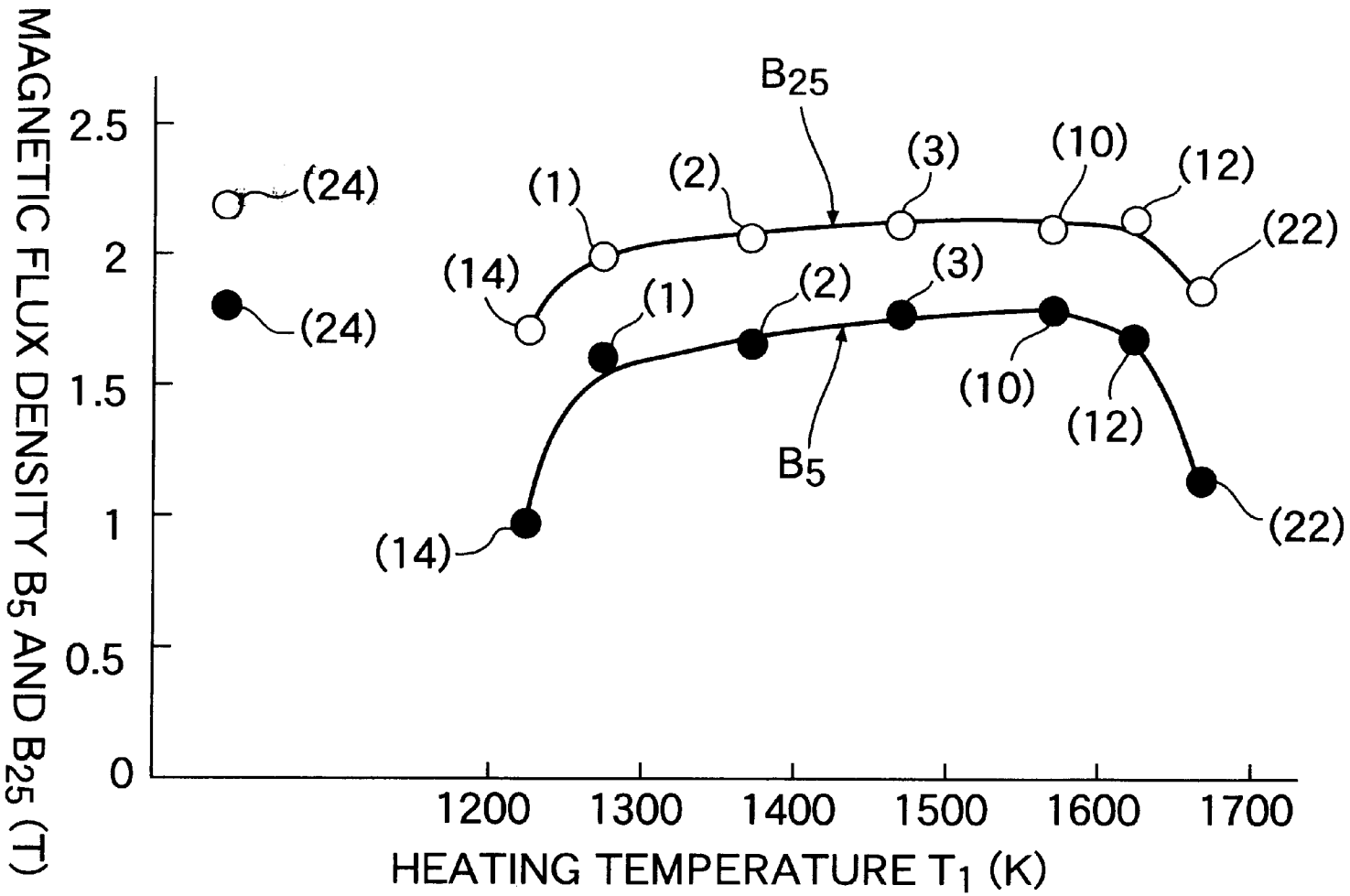
FIG. 4 is a graph showing the relationship between the heating temperature and the magnetic flux densities $B_5$, $B_{25}$ of alloys according to examples of the invention.
Figure 5:
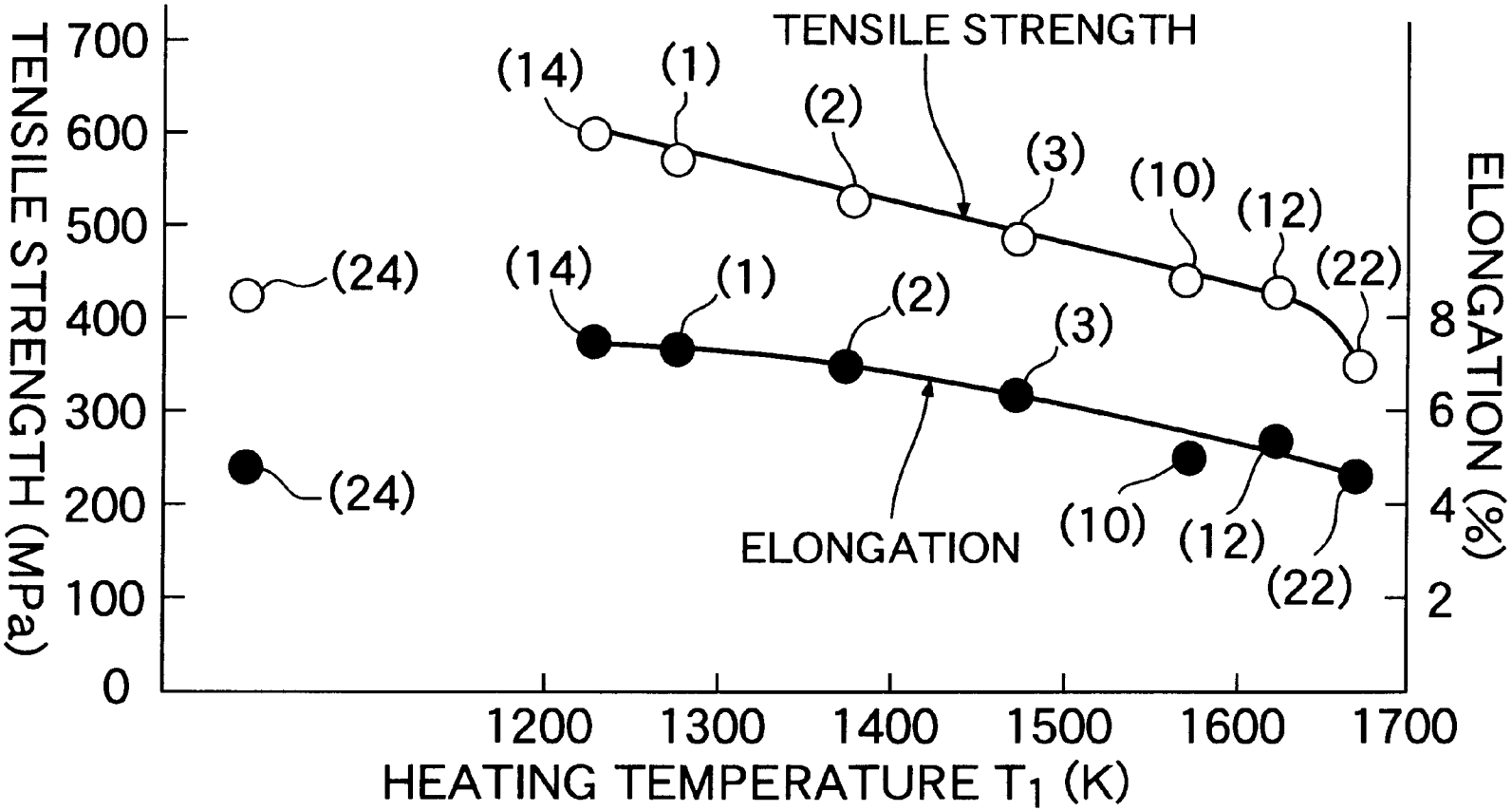
FIG. 5 is a graph showing the relationship between the heating temperature and the tensile strength as well as the elongation of alloys according to the examples of the invention.
Figure 6:
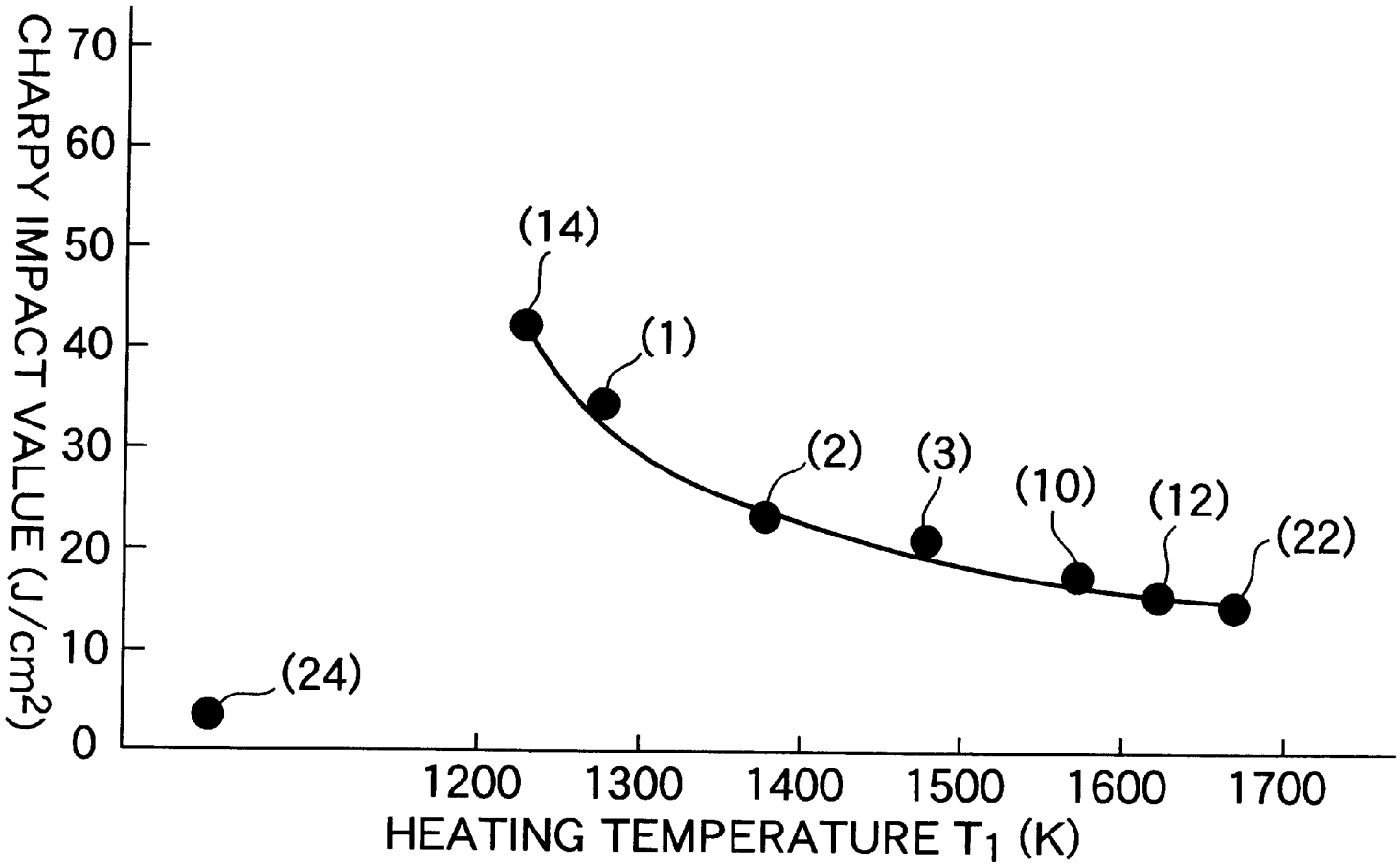
FIG. 6 is a graph showing the relationship between the heating temperature and the Charpy impact value of alloys according to the examples of the invention.

FIGS. 4, 5 and 6 are graphs showing the heating temperature $T_1$ in the first step versus magnetic flux densities $B_5$ and $B_{25}$, tensile strength and elongation as well as Charpy impact value, taken based on Tables 1 to 4 for Examples 1 to 3, 10, 12, 14, 22 and 24. In each of these Figures, points (1) to (3), (10), (12), (14), (22) and (24) correspond to Examples 1 to 3, 10, 12, 14, 22 and 24, respectively. It can be also seen from FIGS. 4 to 6 that the magnetic properties and the mechanical characteristics are reconciled in Examples 1 to 3, 10 and 12.

The alloy according to the present invention is not limited to the composition containing 49% by weight of Co, 2% by weight of V, and the balance of Fe, and may be a composition which is capable of forming an Fe—Co based ordered alloy. Any of Cr, W, Ti, Ni, Si, Al, B and the like may be used as an alloy element.

What is claimed:

1. A process for producing an Fe—Co based magnetic alloy having excellent mechanical characteristics, comprising the steps (a) heating an Fe—Co based magnetic alloy material having a Co content in a range of 30% by weight$\leqq$Co$\leqq$65% by weight to convert the metallographic structure thereof into a γ single-phase structure, (b) gradually cooling the material to an a single-phase range at a cooling rate $C_1$ set in a range of 20 k°/hr$\leqq C_1 \leqq$0.5 k°/sec, and (c) subjecting the material to a magnetic softening treatment, wherein the steps (a) to (c) are carried out in the mentioned order.

2. The process according to claim 1 wherein the Fe—Co based magnetic alloy material is heated in step (a) at a temperature, $T_1$, in the range of 1,273° K to 1,623° K.

3. The process according to claim 1 wherein heating in step (a) is maintained for a period of 0.5 hour to 10 hours.

4. The process according to claim 1 wherein the magnetic softening treatment comprises heating said Fe—Co based magnetic alloy for a period of time at a temperature, $T_2$, in the range of 1,073° K to 1,143° K.

5. The process according to claim 4 wherein said period of time is in the range of 0.5 hour to 10 hours.

6. The process according to claim 4 wherein the magnetic softening treatment further comprises a cooling program including a gradual first cooling stage and a second cooling stage having a more rapid cooling rate than said first cooling stage.

7. The process according to claim 6 wherein the gradual cooling stage takes place from $T_2$ to about 973° K, $T_3$.

8. The process according to claim 6 wherein the second cooling stage takes place from $T_3$ to room temperature, $T_4$.

9. The process according to claim 6 wherein the second cooling stage occurs at a rate of $\leqq 0.06$ K°/sec.

10. The process according to claim 1 wherein a mixed $\alpha$–$\alpha'$ structure is formed in step (c).

* * * * *